US010016647B1

(12) United States Patent
Perez

(10) Patent No.: US 10,016,647 B1
(45) Date of Patent: Jul. 10, 2018

(54) WEIGHTED EXERCISE APPARATUS

(71) Applicant: Jonathan Perez, Colorado Springs, CO (US)

(72) Inventor: Jonathan Perez, Colorado Springs, CO (US)

( * ) Notice: Subject to any disclaimer, the term of this patent is extended or adjusted under 35 U.S.C. 154(b) by 0 days.

(21) Appl. No.: 15/049,912

(22) Filed: Feb. 22, 2016

(51) Int. Cl.

| | |
|---|---|
| ***A63B 15/00*** | (2006.01) |
| ***A63B 21/06*** | (2006.01) |
| ***A63B 21/072*** | (2006.01) |
| ***A63B 21/00*** | (2006.01) |
| ***A63B 37/12*** | (2006.01) |

(52) U.S. Cl.
CPC ..... *A63B 21/072* (2013.01); *A63B 21/0604* (2013.01); *A63B 21/4033* (2015.10); *A63B 37/12* (2013.01)

(58) Field of Classification Search
CPC ..... A63B 21/072; A63B 21/4033; A63B 21/0604; A63B 37/12; A63B 15/00; A63B 21/4035; A63B 21/075; A63B 21/0004; A63B 21/06; A63B 23/12; A63B 21/4017; A63B 21/0602; A63B 21/0728; A63B 69/36; A63B 69/3623; A63B 15/005; A63B 2069/0008; A63B 21/0603; A63B 21/4043; A63B 43/02; A63B 23/0211; A63B 69/3632; A63B 2023/003
USPC ..... 482/109
See application file for complete search history.

(56) References Cited

U.S. PATENT DOCUMENTS

| | | | | | |
|---|---|---|---|---|---|
| 1,930,342 | A * | 10/1933 | Graham | A63B 69/3632 | 473/232 |
| 3,743,297 | A * | 7/1973 | Dennis | A63B 15/00 | 473/242 |
| 3,874,660 | A * | 4/1975 | Brethen | A63B 15/00 | 482/109 |
| D241,958 | S | 10/1976 | Smith | | |
| 4,302,008 | A | 11/1981 | Lard | | |
| 4,444,396 | A * | 4/1984 | Wendt | A63B 15/00 | 473/242 |
| 4,602,788 | A * | 7/1986 | Wendt | A63B 15/00 | 473/242 |
| 4,819,935 | A * | 4/1989 | Dirksing | A63B 15/00 | 473/256 |
| 5,039,098 | A * | 8/1991 | Pelz | A63B 53/02 | 473/306 |
| 5,100,148 | A * | 3/1992 | Smith | A63B 15/00 | 473/228 |
| 5,316,306 | A * | 5/1994 | Cody | A63B 69/3632 | 473/239 |

(Continued)

*Primary Examiner* — Andrew S Lo

(57) ABSTRACT

A weighted exercise apparatus including a substantially cylindrical handle having a back end, a front end, a threaded opening disposed within the front end, a back portion, a front portion attached to the back portion, a lip disposed between the back portion and the front portion, and a gripping member disposed on the back end. At least one rubberized weighted ball has a continuous cylindrical aperture medially disposed through a diameter of the at least one weighted ball. The front portion of the handle is removably disposed through the aperture of the at least one weighted ball. A wing screw having a wingspan greater than a diameter of the aperture of the at least one weighted ball selectively threadably engages the threaded opening of the handle when the front portion of the handle is disposed through the aperture of the at least one weighted ball.

3 Claims, 4 Drawing Sheets

(56) References Cited

U.S. PATENT DOCUMENTS

| | | | | | |
|---|---|---|---|---|---|
| D428,461 | S * | 7/2000 | Koszalinski | D21/791 | |
| 6,120,385 | A * | 9/2000 | Nemeckay | A63B 15/00 | 473/256 |
| 6,769,996 | B2 * | 8/2004 | Tseng | A63B 53/02 | 473/306 |
| 7,285,080 | B1 * | 10/2007 | Chiu | A63B 21/0004 | 482/142 |
| 7,335,113 | B2 * | 2/2008 | Hocknell | A63B 53/00 | 473/307 |
| D566,205 | S * | 4/2008 | Oates | D21/662 | |
| D573,670 | S * | 7/2008 | Mullins | D21/679 | |
| 7,553,239 | B2 | 6/2009 | Pullaro | | |
| 8,182,401 | B2 | 5/2012 | Clemons | | |
| 8,529,365 | B1 * | 9/2013 | Davis | A63B 15/00 | 473/256 |
| 9,468,816 | B2 * | 10/2016 | Barelmann | A63B 53/02 | |
| 2001/0001094 | A1 * | 5/2001 | Panes | A63B 21/06 | 482/93 |
| 2003/0004041 | A1 * | 1/2003 | Hartman | A63B 21/4001 | 482/106 |
| 2004/0009826 | A1 * | 1/2004 | Aisenberg | A63B 15/00 | 473/256 |
| 2012/0149539 | A1 | 6/2012 | Quader | | |
| 2014/0051527 | A1 * | 2/2014 | Sato | A63B 53/02 | 473/307 |
| 2014/0051554 | A1 | 2/2014 | Walker | | |
| 2014/0057763 | A1 | 2/2014 | Fritsch | | |
| 2015/0005090 | A1 * | 1/2015 | Parker | A63B 69/3632 | 473/226 |

* cited by examiner

WEIGHTED EXERCISE APPARATUS

BACKGROUND OF THE INVENTION

Various types of exercise apparatuses are known in the prior art. However, what has been needed is a weighted exercise apparatus including a substantially cylindrical handle having a back end, a front end, a threaded opening disposed within the front end, a back portion, a front portion attached to the back portion, a lip disposed between the back portion and the front portion, and a gripping member disposed on the back end. What has been further needed is at least one rubberized weighted ball having a continuous cylindrical aperture medially disposed through a diameter of the at least one weighted ball. Lastly, what has been needed is for the front portion of the handle to be removably disposed through the aperture of the at least one weighted ball and for a wing screw having a wingspan greater than a diameter of the aperture to selectively threadably engage the threaded opening of the handle when the front portion of the handle is disposed through the aperture. The weighted exercise apparatus thus blends the concepts of both hammer training and tire training, without the need for large or awkwardly sized equipment. By swinging the apparatus and varying the weight of the at least one weighted ball, a user can reap even greater muscular strength training benefits than with hammer and tire training, since the user will have greater variation in strength training exercises and greater flexibility in the amount of space required for the exercises.

FIELD OF THE INVENTION

The present invention relates to exercise apparatuses, and more particularly, to a weighted exercise apparatus.

SUMMARY OF THE INVENTION

The general purpose of the present weighted exercise apparatus, described subsequently in greater detail, is to provide a weighted exercise apparatus which has many novel features that result in a weighted exercise apparatus which is not anticipated, rendered obvious, suggested, or even implied by prior art, either alone or in combination thereof.

To accomplish this, the present weighted exercise apparatus includes a substantially cylindrical handle having a back end, a front end, a threaded opening disposed within the front end, a back portion, a front portion attached to the back portion, a lip disposed between the back portion and the front portion, and a gripping member disposed on the back end. The weighted exercise apparatus further includes at least one rubberized weighted ball having a continuous cylindrical aperture medially disposed through a diameter of the at least one weighted ball. A circumference of the front portion of the handle substantially conforms to a circumference of the aperture of the at least one weighted ball, and a length of the front portion of the handle substantially conforms to a length of the aperture of the at least one weighted ball.

The front portion of the handle is removably disposed through the aperture of the at least one weighted ball. A wing screw having a wingspan greater than a diameter of the aperture of the at least one weighted ball selectively threadably engages the threaded opening of the handle when the front portion of the handle is disposed through the aperture of the at least one weighted ball. The at least one weighted ball optionally includes a plurality of weighted balls, with each of the plurality of weighted balls having various weights. Thus, a user can easily modify the weight attached to the handle by manually unscrewing the wing screw and fitting a different weighted ball through the handle. The gripping member of the handle is optionally rubberized for a more secure grip.

Thus has been broadly outlined the more important features of the present weighted exercise apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
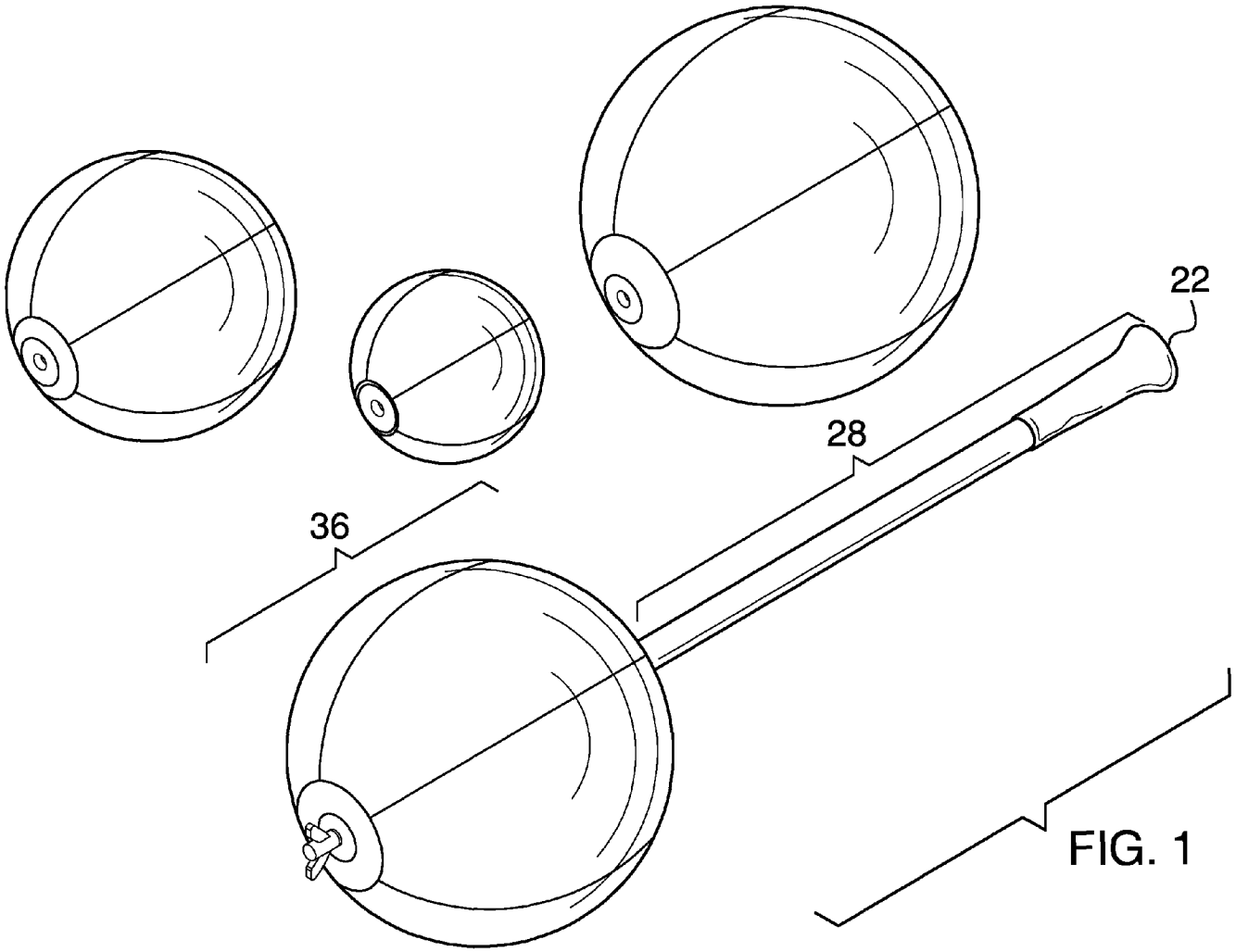
FIG. 1 is a front isometric view.
Figure 2:
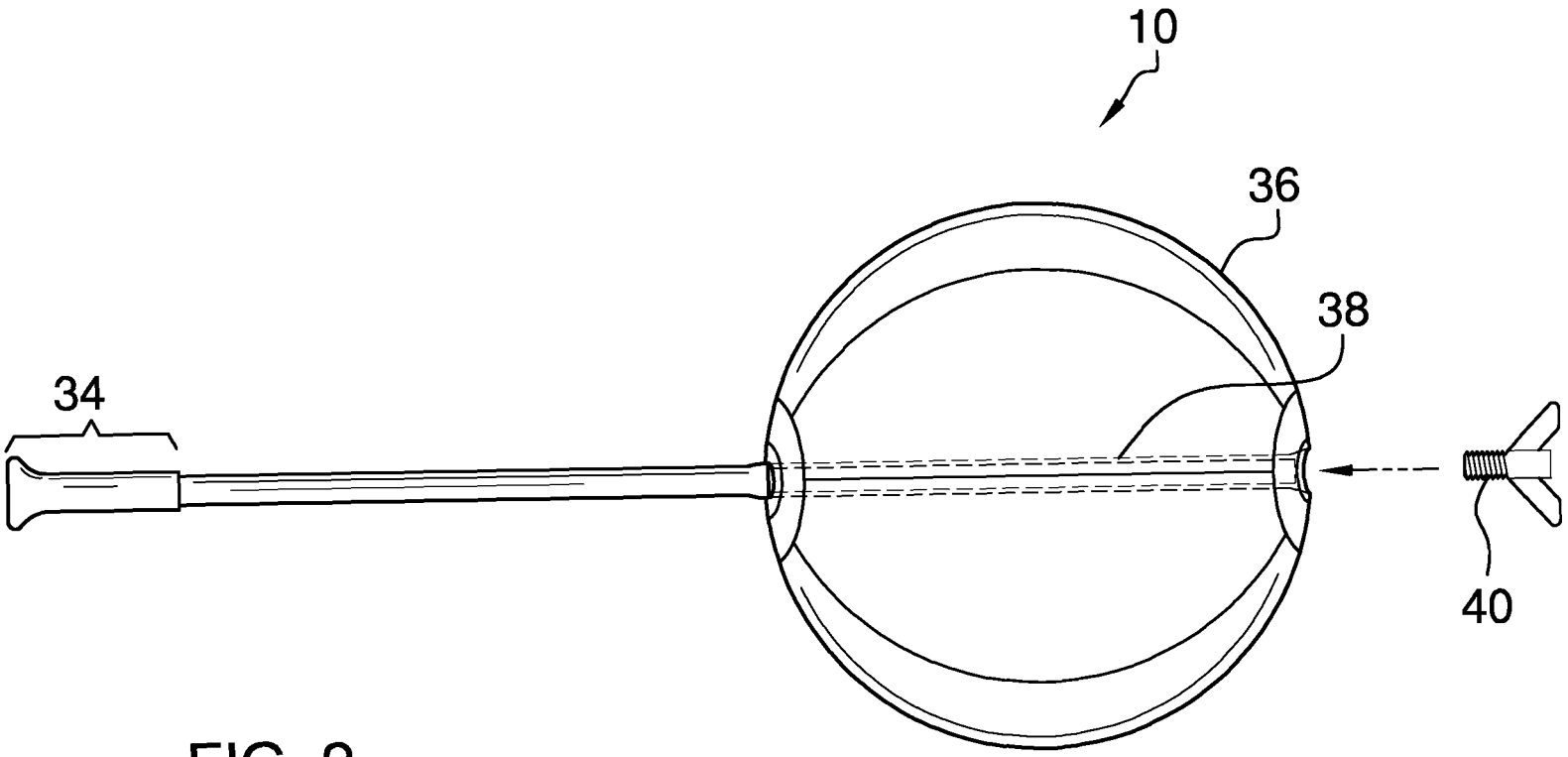
FIG. 2 is a side elevation view.
Figure 3:
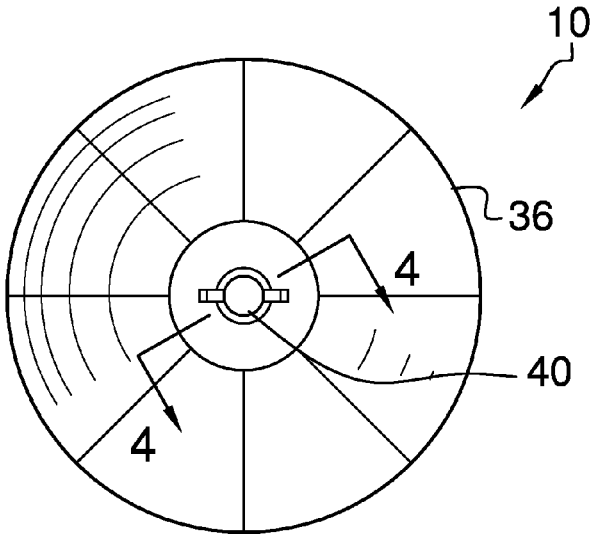
FIG. 3 is a front elevation view.
Figure 4:
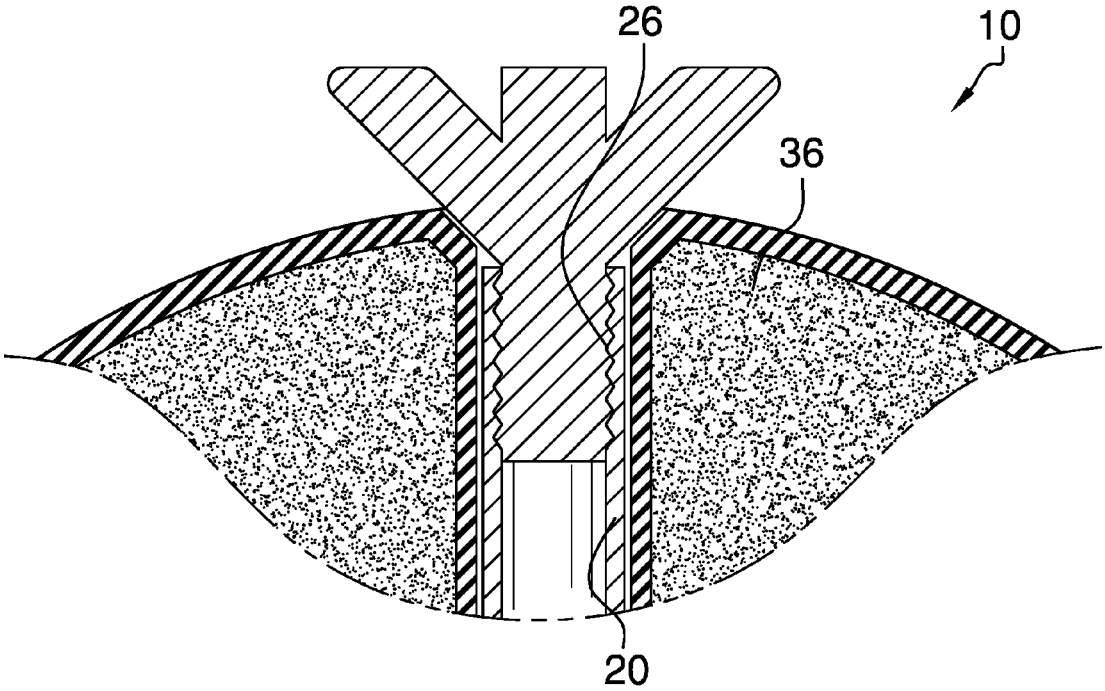
FIG. 4 is a cross-sectional view taken along line 4-4 of FIG. 3.
Figure 5:
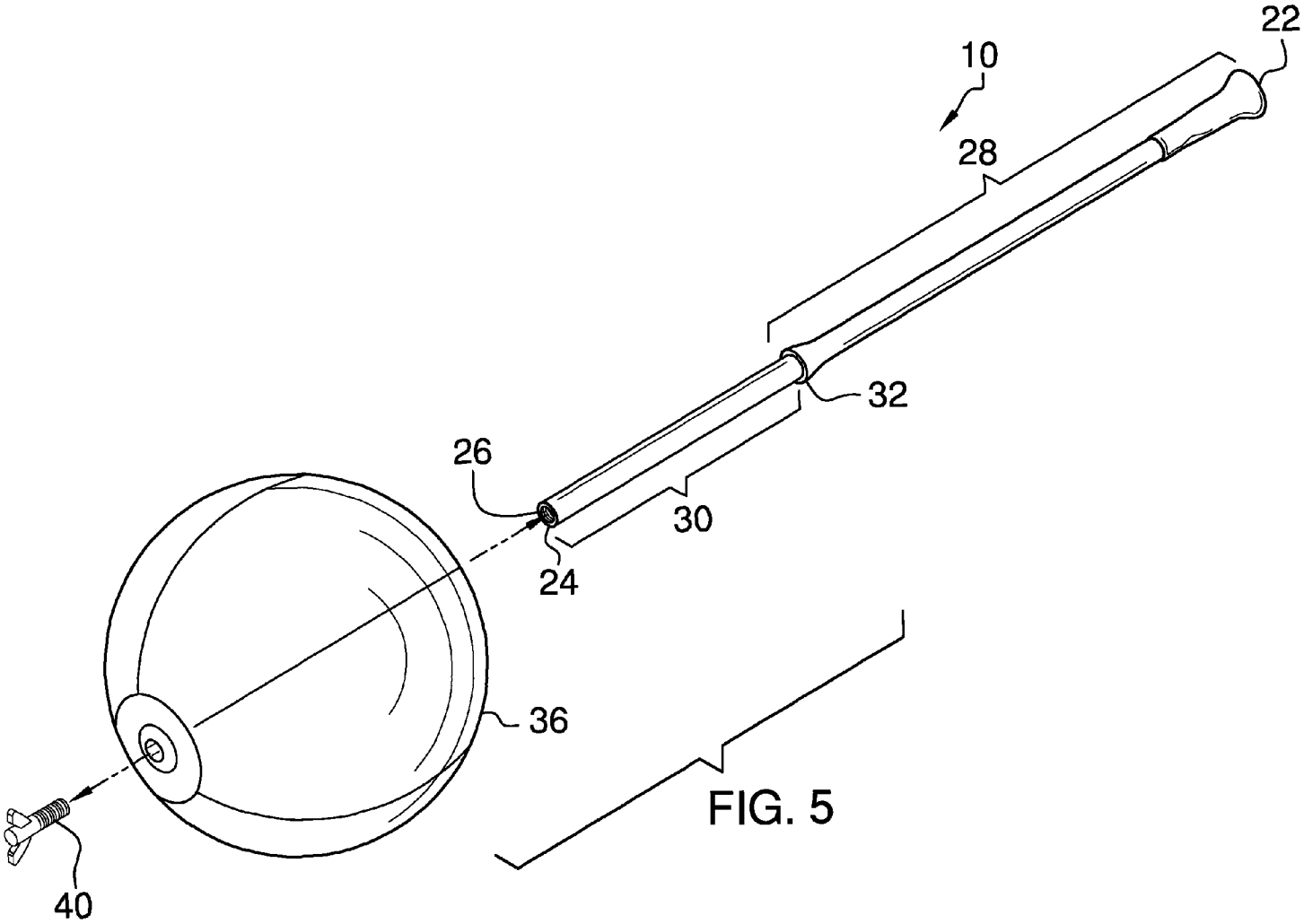
FIG. 5 is an exploded view.

With reference now to the drawings, and in particular FIGS. 1 through 5 thereof, an example of the instant weighted exercise apparatus employing the principles and concepts of the present weighted exercise apparatus and generally designated by the reference number 10 will be described.

Referring to FIGS. 1 through 5 the present weighted exercise apparatus 10 is illustrated. The weighted exercise apparatus 10 includes a substantially cylindrical handle 20 having a back end 22, a front end 24, a threaded opening 26 disposed within the front end 24, a back portion 28, a front portion 30 attached to the back portion 28, a lip 32 disposed between the back portion 28 and the front portion 30, and a gripping member 34 disposed on the back end 22. The weighted exercise apparatus 10 further includes at least one rubberized weighted ball 36 having a continuous cylindrical aperture 38 medially disposed through a diameter of the at least one weighted ball 36. A circumference of the front portion 30 of the handle 20 substantially conforms to a circumference of the aperture 38 of the at least one weighted ball 36, and a length of the front portion 30 of the handle 20 substantially conforms to a length of the aperture 38 of the at least one weighted ball 36.

The front portion 30 of the handle 20 is removably disposed through the aperture 38 of the at least one weighted ball 36. A wing screw 40 having a wingspan greater than a diameter of the aperture 38 of the at least one weighted ball 36 selectively threadably engages the threaded opening 26 of the handle 20 when the front portion 30 of the handle 20 is disposed through the aperture 38 of the at least one weighted ball 36. The gripping member 34 of the handle 20 is optionally rubberized.

What is claimed is:

1. A weighted exercise apparatus comprising:

a substantially cylindrical handle having a back end, a front end, a threaded opening disposed within the front end, a back portion, a front portion attached to the back portion, a lip disposed between the back portion and the front portion, and a gripping member disposed on the back end; and a rubberized weighted ball having a continuous cylindrical aperture medially disposed through a diameter of the weighted ball;

wherein a circumference of the front portion of the handle substantially conforms to a circumference of the aperture of the weighted ball;

wherein a length of the front portion of the handle substantially conforms to a length of the aperture of the weighted ball;

wherein the front portion of the handle is removably disposed through the aperture of the weighted ball;

wherein a wing screw having a wingspan greater than a diameter of the aperture of the weighted ball has a threaded portion that is configured to selectively and threadably engage the threaded opening of the handle when the front portion of the handle is disposed through the aperture of the weighted ball, and wherein the threaded portion of the wing screw can be threadably disengaged from the threaded opening of the handle to remove the weighted ball from the handle.

2. The weighted exercise apparatus of claim 1 wherein the gripping member of the handle is rubberized.

3. The weighted exercise apparatus of claim 1, comprising one or more rubberized weighted balls.

* * * * *